United States Patent [19]

Kejnovský et al.

[11] 4,065,942

[45] Jan. 3, 1978

[54] PANTIES OR THE LIKE AND METHOD OF MANUFACTURING SAME

[75] Inventors: Bohumil Kejnovský; Miroslav Kopečný, both of Trebic, Czechoslovakia

[73] Assignee: ELITEX, Zavody textilniho strojirenstvi generalni reditelstvi, Liberec, Czechoslovakia

[21] Appl. No.: 641,642

[22] Filed: Dec. 17, 1975

[30] Foreign Application Priority Data

Dec. 22, 1974 Czechoslovakia ..... 8872/74

[51] Int. Cl.[2] ..... A41B 9/02; A41B 9/04

[52] U.S. Cl. ..... 66/177; 66/41

[58] Field of Search ..... 66/175, 178, 41

[56] References Cited

U.S. PATENT DOCUMENTS

| | | | |
|---|---|---|---|
| Re. 27,886 | 1/1974 | Johnson | 66/177 |
| 3,109,300 | 11/1963 | Garrou et al. | 66/177 |
| 3,109,301 | 11/1963 | Garrou et al. | 66/177 |
| 3,128,475 | 4/1964 | Rice et al. | 66/177 X |
| 3,938,355 | 2/1976 | Conti | 66/177 |

*Primary Examiner*—Ronald Feldbaum

[57] ABSTRACT

Textile article of tubular shape as, e.g. panties and similar articles, with a body portion and leg portions, made integrally in a circular knitting machine, wherein the knitwork of the body portion is made as at least a double knitwork in an area covering substantially the part between the waist opening and the crotch part of said article.

Method of manufacturing the above textile article, wherein a first tubular portion is knitted, is transferred upon finishing below the needle latches, and remains suspended on the needle shanks, a second portion is knitted thereafter as a double welt and a longitudinal gap is formed, the last loops of the first portion and of the first part of the double welt are joined by knitting after having knitted the first part of the double welt, whereupon the second part of the double welt is knitted with a longitudinal gap, both parts of the double welt being joined and the knitting of the tubular part of the second portion being continued.

11 Claims, 31 Drawing Figures

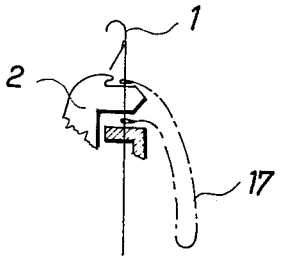
Fig-12
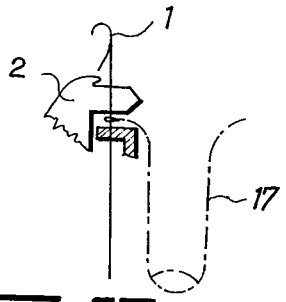
Fig-13
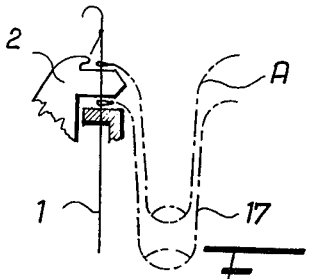
Fig-14
Fig-15
Fig-16
Fig-17
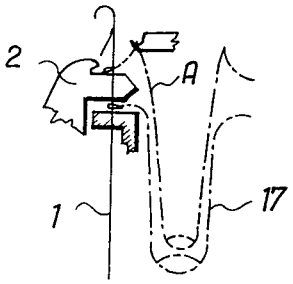
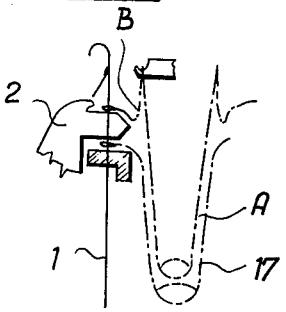
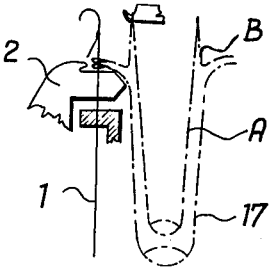
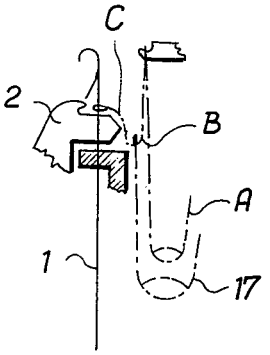
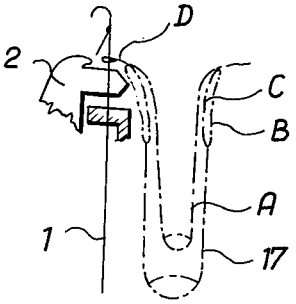
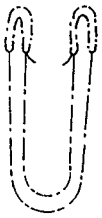
Fig-18
Fig-19
Fig-20

FIG-20
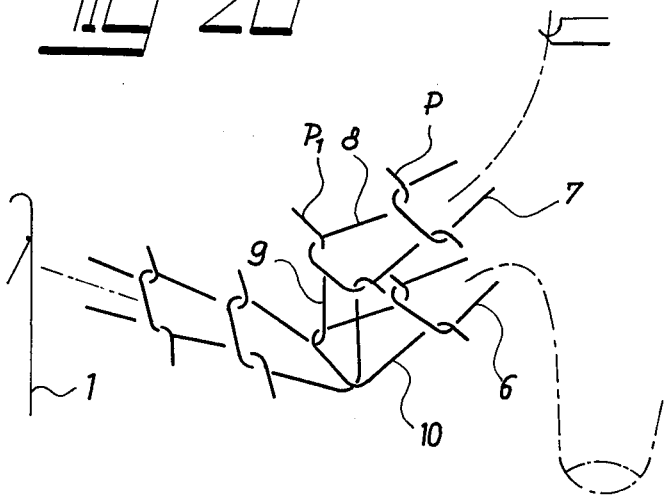
FIG-21
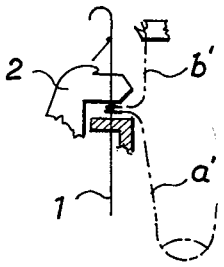
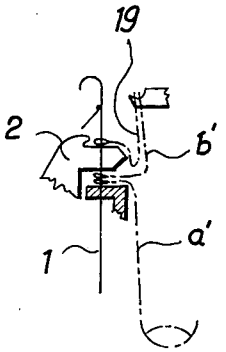
FIG-22
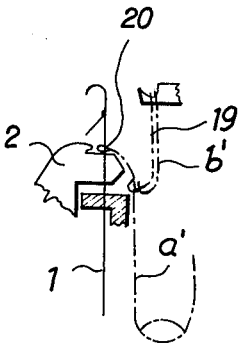
FIG-23
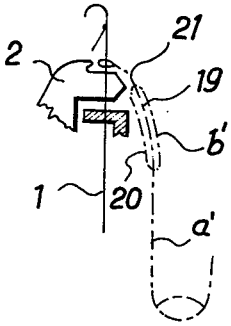
FIG-24
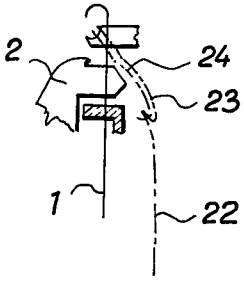
FIG-25
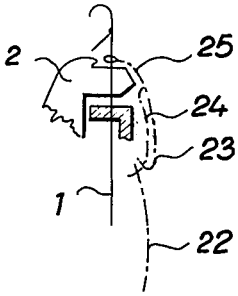
FIG-26

PANTIES OR THE LIKE AND METHOD OF MANUFACTURING SAME

This invention is related to those disclosed and claimed in copending coassigned U.S. patent applications Ser. No. 621,773 of Musil et al. and Ser. No. 636,432 of Zouhar et al.

The present invention relates to a textile article such as panties and similar articles consisting of a body part and leg parts made integrally in a circular knitting machine.

It is known that some panties are manufactured integrally by knitting in small diameter knitting machines, so that the article leaves the machine with closed toes and a knitted-in elastic waist. One of the known types of pants is manufactured by a rotary method from toe to toe, thus forming a hose-like knitwork with a waist opening formed by knitting courses. In a further known method of knitting, the body part is knitted by reverse motion, the wasit opening being formed by reversing the direction of running of the machine. The product thus obtained is a plain knitwork.

As far as the use or wearing of the above-mentioned panties is concerned, it is necessary to wear short drawers under those panties.

The present invention has among its objects the removal of the necessity of wearing any underwear in addition to the panties, the present product being worn directly against the skin. This result is secured by making the knitwork of the body part, in the area at least substantially between the waist opening and the crotch, in the form of a double knitwork.

The product according to the present invention and the method of manufacturing the same are illustrated by embodiments in the form of examples in the accompanying drawings, in which:

FIGS. 12 to 19 are similar to FIGS. 5 to 11 with the exception that the body part is formed last;

FIG. 20 is a diagrammatic view of the panties formed by the procedure illustrated by FIGS. 12 to 19;

FIGS. 21 to 24 are diagrammatic views showing the procedure for forming the first two parts of panties formed of three independently knitted parts;

FIGS. 25 and 26 are diagrammatic views of the procedure of panties formed of four independently knitted parts for forming the first three parts;

FIGS. 27 and 28 show knitwork structures for joining two and three parts, respectively, of the panties;

Figure 5:
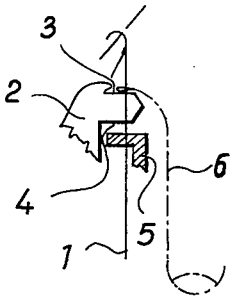
FIGS. 5 to 11 are diagrammatic views showing the procedure of forming panties made of two independently knitted parts from toe to toe.

In the following specification, the forming of the panties of two independent knitted parts is now first described. The knitwork is made by needles 1 (FIG. 5) and sinkers 2 which are so made that they have a knock over edge 3 and an edge 4 for locking the last loops of the knitwork hanging on the shanks of needles 1 above the sinker ring 5, as described in the coassigned application Ser. No. 621,773, filed Oct. 14, 1975, of Musil et al., in which there is also described a cam system for controlling needles 1 and sinkers 2 for this purpose.

Figure 2:
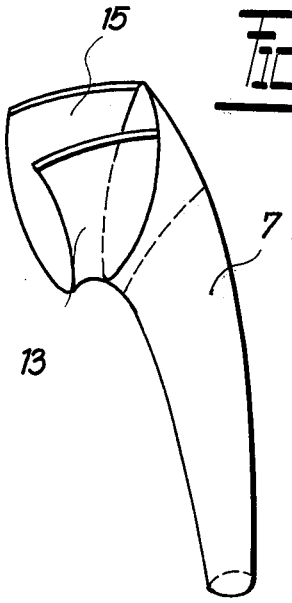
FIG. 2 is a diagrammatic view of one of the two independent parts of the panties of FIG. 1.
Figure 3:
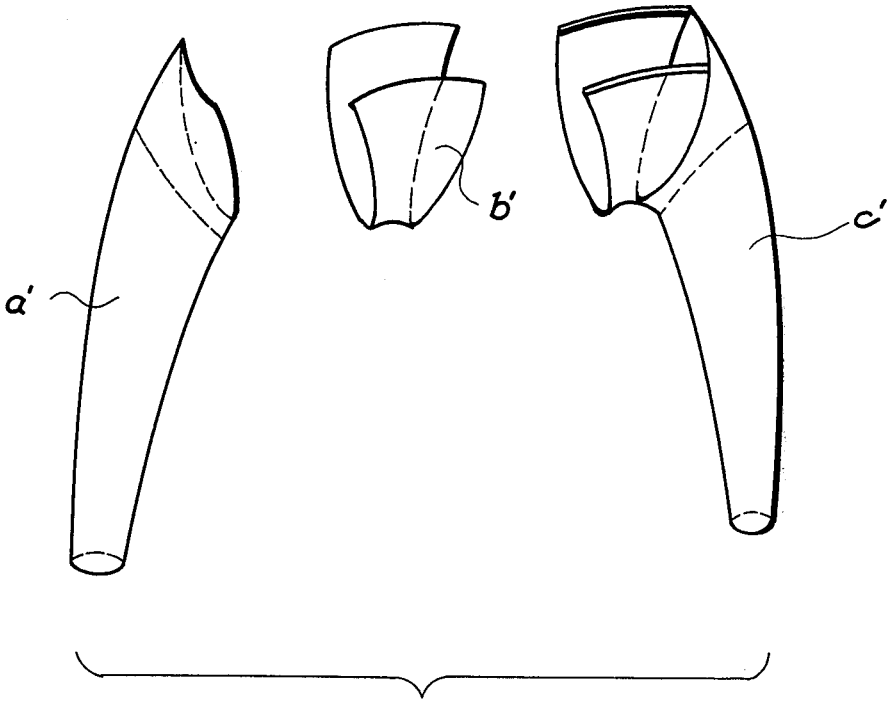
FIG. 3 is an exploded diagrammatic view of panties made of three independent parts.
Figure 6:
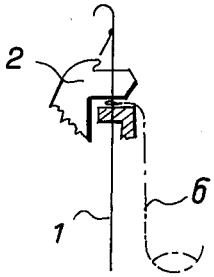
Figure 7:
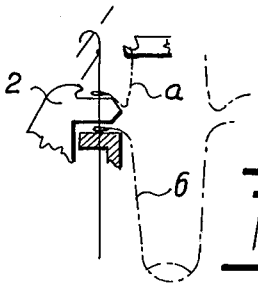
Figure 8:
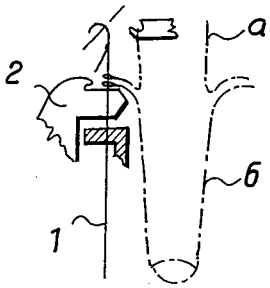
Figure 9:
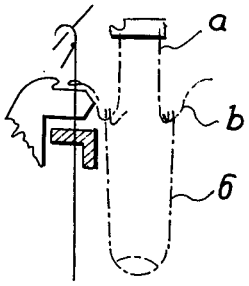

At first there is knitted the first part 6 (FIG. 5) of the product, which comprises a successively knitted closed toe part, a leg part and a part of the body portion, as can be seen from portion *a* in FIG. 3. After finishing portion 6, the same is transferred below the latches of needles 1 and further into the lower position as shown in FIG. 6. During the further procedure, the second portion 7 (FIG. 2) is knitted, i.e., its first part *a* (FIG. 7) as a double welt by means of dial sinkers. A certain number of needles 1 do not knit and the yarn is cut out, e.g., 60 needles are in inoperative position, whereby a rounded-off strip with a longitudinal gap is formed, which is similar to part *b* in FIG. 3. After knitting the necessary length, the last loops of part *a* and part 6 are transferred under the latches of needles 1 as shown in FIG. 8. New yarn is laid into the needles, which in the further procedure joins both parts 6 and 7, the gap in part *a*, and the appurtenant part of the circumference of part 6 thus forming a transversal selvedge of the opening for the user's waist. Then the other part *b* (FIG. 9) of portion 7 is knitted which remains transferred.

The joining of portions 6 and 7 may be performed in two manners. As already mentioned, a new yarn is laid, the loops of portions 6 and 7 being below the latches of the needles. The first part *a* of portion 7 (FIG. 28) is knitted from yarn P and loop 9 from the new laid yarn $P_1$ is pulled through the last loop 8 of yarn P. Simultaneously, loop 9 is also pulled through the last loop 10 of first portion 6. Then the other part *b* of portion 7 is knitted from yarn $P_1$. Further, portions 6 and 7 can be joined in such manner that the last loop 11 (FIG. 27) of first part *a* of second portion 7 is not transferred below the latch of needle 1, but remains in the hook and is pulled through the last loop 12 of portion 6, after which the knitting of part *b* of portion 7 by the same yarn is carried on.

Figure 10:
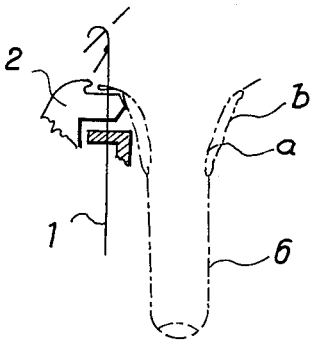
Figure 11:
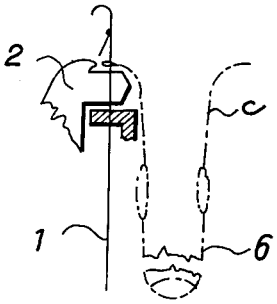

After knitting the other part *b* of portion 7, the knitwork or part *a*, respectively, is transferred back to needles 1 (FIG. 10) and the third part *c* (FIG. 11) of portion 7 is knitted on all needles 1, thus forming a second transverse selvedge of the opening for the user's waist. The third part *c* of portion 7 then comprises the remaining part of the body portion, a leg portion and a closed toe part.

Figure 1:
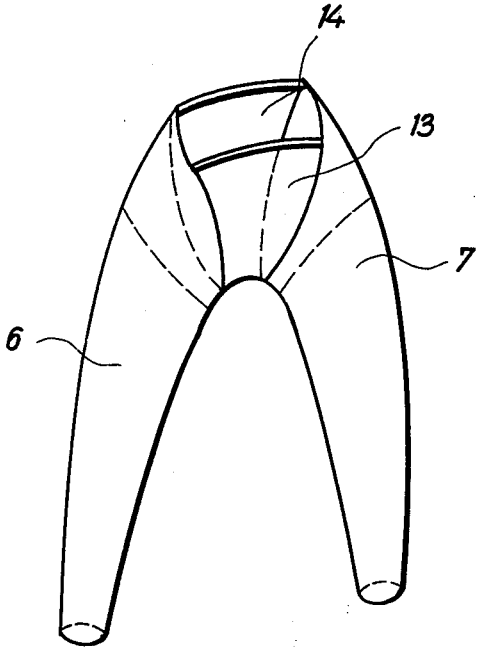
FIG. 1 is a diagrammatic view of a first embodiment of the panties according to the present invention, such panties being made of two independent parts.
Figure 4:
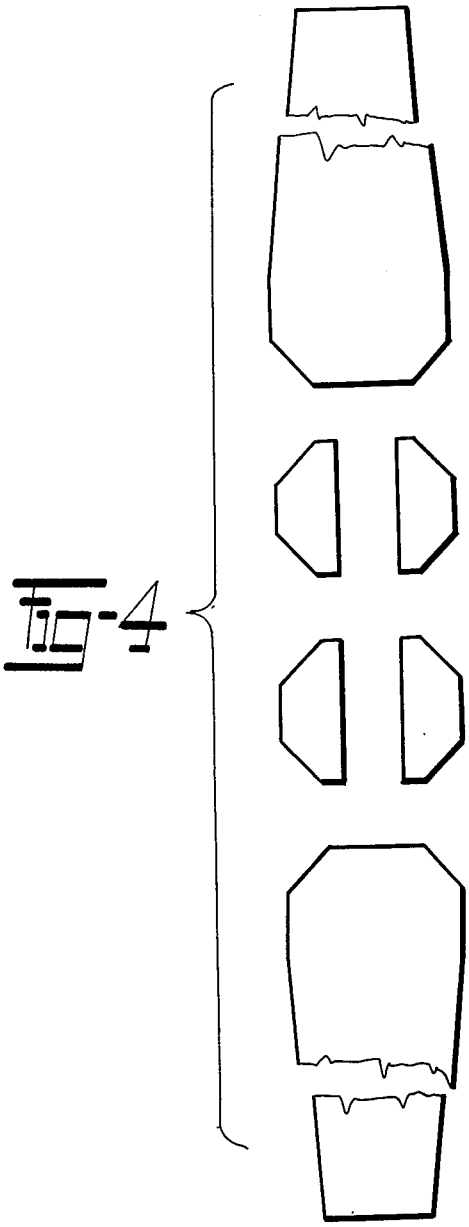
FIG. 4 is an exploded diagrammatic view of panties made of four independent parts, the panties being shown developed in a plane and showing the waist opening.
Figure 29:
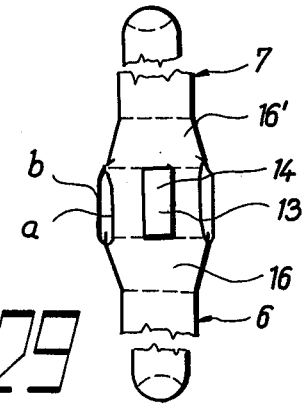
FIG. 29 is a diagrammatic view showing the joining of two parts of panties manufactured as shown in FIGS. 5 to 11 with a knitwork structure shown in FIG. 27.
Figure 30:
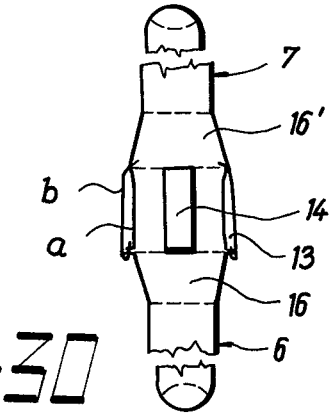
FIG. 30 is the same as FIG. 29 with the exception that the knitwork structure is that shown in FIG. 28.
Figure 27:
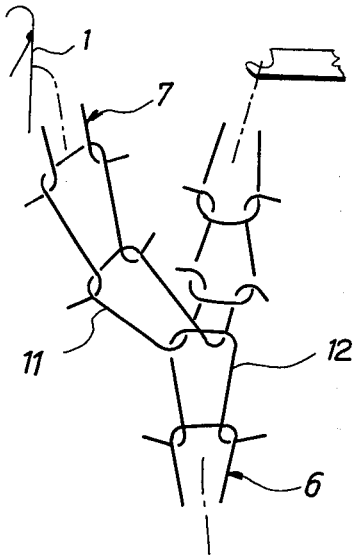

In the method described above, panties as shown in FIG. 1 are formed of two independent portions 6 and 7, with a double knitwork 13 in the body portion which is distributed from the longitudinal selvedges of opening 14 about the circumference of the knitwork hose. The second portion 7 (FIG. 2) then comprises a hose-like knitwork with a closed toe part, at the other end of which there is a double welt with a longitudinal gap 15. As can be seen from FIGS. 1, 2 and 4, the body portion can be accordingly shaped upon knitting a double welt, e.g., by knitting partial courses. In FIGS. 29 and 30, the forming of longitudinally shaped panties is shown together with representing the ratio of dimensions of opening 14 to the double part 13 of the body portion, while the remaining parts 16 and 16' are simple; FIG. 29 shows the structure from FIG. 27 and FIG. 30 shows the structure from FIG. 28, the structures of both FIGS. 29 and 30 being for joining portions 6 and 7.

Figure 31:
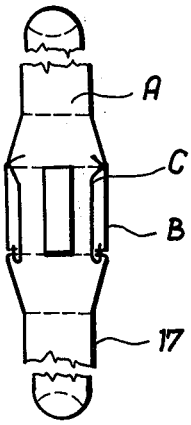
FIG. 31 is a diagrammatic view of the joining of two parts of panties manufactured by the procedure shown in FIGS. 12 to 19 with a knitwork structure shown in FIG. 28.

In the following part, the second method of manufacturing panties of two parts is described. At first, again in a known manner, the first portion 17 (FIG. 12) is formed in a similar manner as a double welt, but by means of needles 1 and sinkers 2. The first part of the body portion is knitted first, then the leg portion which is finished by the closed toe part, which is pressed off needles 1, as shown in FIG. 13, the knitwork being thus reversed and remaining suspended on the shanks of needles 1 below the knock-over plane. On needles 1 there is then knitted the first part A (FIG. 14) of the second portion with a closed toe part, a leg portion and a part of the body portion. After knitting the necessary length, part A is transferred to dial sinkers, as shown in FIG. 15 and the knitting of the second part B (FIG. 16) of the second portion is carried on. A certain number of needles 1, e.g., 60 needles, do not take part in the knitting process, a longitudinal gap for the waist opening thus being formed in part B in a manner similar to the preceding case. After knitting the necessary length for part B, the last loops of portion 17 are transferred above the knock-over plane, as shown in FIG. 17 and the two portions of the panties are joined in a known manner, the result of which is the structure shown in FIG. 27. By this procedure, the first transverse selvedge of the waist opening is finished. The knitting process is carried on by knitting the third part C of the second portion (See FIG. 18), the forming of the longitudinal gap being carried on. After knitting part C, which corresponds to part B as to its length, the knitwork is transferred from the dial sinkers to needles 1. Thus, the second transverse selvedge of the waist opening is formed on needles 1. In a further knitting step joining courses D are formed as shown in FIG. 19, and the article is knocked off needles 1, and can be put on a form in the shape shown in FIG. 20. The finished article is then formed and by pulling the leg portions back through the opening in a condition which corresponds to the panties shown in FIG. 31, in which, however, the joining by means of the structure shown in FIG. 28 is shown.

A further method of forming panties according to the present invention consists in forming them of three independently knitted portions. At first, the first hose portion *a'* (FIG. 3) is knitted, which corresponds to portion 6 in FIG. 6, and thereafter the second portion *b'*, which corresponds to portion *a* shown in FIG. 7, of which the last loops are transferred below the knock-over plane to the shanks of needles 1, as shown in FIG. 21, said loops being there together with loops of portion *a'*. In a further step, the first part of the third portion *c'* is knitted, which is denoted by reference character 19 (FIG. 22) as a double welt, with a longitudinal gap, as portion 6'. After knitting the corresponding length of part 29, the last loops *a'* and *b'* are transferred above the knock-over plane in such manner that the last loops of part 19 remain in the hooks of needles 1 and are pulled through the last loops of portions *a'* and *b'* in a manner similar to the pulling through of loop 9 in FIG. 28. Further, the knitting of second part 20 of the third portion *c* is continued. By the procedure as mentioned above, the first transverse edge of the waist opening was formed on needles 1. After knitting the corresponding length of part 20 with a gap, the portion *b'* and part 19 are transferred back to needles 1 and knitting is continued on all needles 1, thus forming the third tubular part 21 of portion *c'*, as shown in FIG. 24, which comprises the rest of the body portion, the leg portion and a closed toe part, and the article is knocked off needles 1.

By this procedure, an article is formed which consists of three portions *a'*, *b'*, *c'*, as shown in FIG. 3, in which a second portion *b'* having the shape of a not closed circular knitwork ribbon, the central part of the body portion being threefold.

A further modification of the method of manufacture of panties according to the present invention consists in forming panties of four independently knitted portions. The procedure of manufacture is the same as that used for the article consisting of three portions until the moment at which there have been manufactured three portions which are identical to portions *a'*, *b'* and portions 19 shown in FIG. 22, such portions being shown in FIG. 25 and being denoted 22, 23 and 24. Then the last loops of portions 22 and 23 are transferred above the knock-over plane, and the last loops of portions 24, which remain in the hooks of needles 1, are pulled through the last loops of portions 22 and 23 in a manner similar to that in the structure shown in FIG. 28 and several securing courses are knitted, whereupon the first transverse edge of the waist opening is formed. In the further step, the last loops of the securing courses are knocked off the needles, the situation shown in FIG. 25 being thus achieved. The start course loops of portions 23 and 24 on which said portions are suspended on the dial sinkers are transferred back to needles 1 and the fourth tubular portion 25 (FIG. 26) is now being knitted on all needles, said portion comprising the rest of the body portion, a leg portion and a closed toe part. Upon beginning to knit portion 25, the second transverse edge of the waist opening and thus the whole waist opening is formed. The final article then has a double knitwork in the body portion.

Upon knitting panties according to the present invention, it is possible to knit rubber and elastic yarns into the transverse and longitudinal selvedges of the opening for the purpose of forming an elastic waist. Further, it is possible to shape the body portion, as already mentioned, e.g. by means of partial course, tuck-stitch pattern, and similar means. The body portion may be knitted on a greater number of needles with respect to the leg portions. For knitting the inner parts, or portions, respectively, of the article, it is advantageous to use a sucking material, e.g., cotton or similar material in combination with elastic yarns for the purpose of maintaining the extensibility of the product. Further, it is possible in the case of a multi-layer knitwork, in shaping the crotch, to form, e.g., on the outer part thereof, an opening, or possibly a longitudinal gap in the double welt. It is also possible, when knitting the inner part of a double knitwork, to knit the said knitwork in the length of the opening of the product on a smaller number of needles with respect of the outer part, said outer part or its selvedges, respectively, being made by using rubber in such manner, that they are twisted into the center of the product over the inner edges of the inner part.

The above-mentioned methods of forming are obviously not limited to the described panties, but can also be used in making articles without closed toe parts, such as short drawers, etc.

Although the invention has been illustrated and described with reference to a plurality of preferred embodiments thereof, it is expressly understood that it is in no way limited by the disclosure of such a plurality of embodiments, but is capable of numerous modifications within the scope of the appended claims.

What is claimed is:

1. In an all-knitted construction for panty hose or similar garments, a first single-knit substantially tubular portion terminating upwardly in a first arcuate selvedge forming one edge of the garment waistband, a second single-knit substantially tubular portion terminating upwardly in a second arcuate selvedge forming an opposite edge of the garment waistband, first and second courses extending in parallel relation between and joined at respective first and second opposite ends thereof to the first and second selvedges to complete the waistband of the garment, and a continuous, arcuate, multi-knit body portion separate from the waistband and extending successively in a downward convex arc between, and joined at its respective opposite ends to, the first and second courses, a lower part of the continuous body portion defining the crotch area of the garment, the transversely opposite surfaces of the body portion being joined to the first and second selvedges.

2. The construction as defined in claim 1, in which the second portion has third and fourth selvedges defined by the first and second courses, respectively, the second ends of the third and fourth selvedges being joined to the first selvedge of the first portion and the associated portions of the first selvedge, respectively.

3. A textile article as claimed in claim 1, wherein to the first portion comprising a first leg part and a continuing round part of the waist portion there is joined about the circumference a third portion and partially said second portion, said second portion being situated inside the third portion and being formed as a circular unclosed waist of the body portion, said third portion comprising with the first portion the rest of the body portion and a longitudinal gap for the waist, made from the selvedge, and a second leg portion, a part of the third portion between the two longitudinal selvedges of the gap being made as a double knitwork, and the second portion being joined to the third and first portions partially about the circumference at the point of finishing the double knitwork except the transverse gap selvedges for the waist.

4. A textile article as claimed in claim 1, wherein to the first tubular portion comprising the first leg part of the leg portion there are joined the first and third parts which are formed as unclosed circular ribbons of the leg portion and which form a double knitwork, a fourth portion being joined thereto about the circumference of their ends, said fourth portion comprising the remaining part of the leg portion and the second leg part.

5. A textile article as claimed in claim 3, wherein through the last loops of at least one portion there are pulled the loops in the top of the knitwork bending in the form of a double welt.

6. A method of manufacturing a textile article of tubular shape having a body portion and leg portions, the body portion having a waist opening, the leg portions being connected to the body portion remote from the waist opening at a crotch part, said article having been made integrally in a circular knitting machine, wherein the knitwork of the body portion is made at least as a double knitwork in an area covering substantially the part between the waist opening in the body portion and the crotch part of said article, comprising knitting a first tubular portion, transferring said first tubular portion upon finishing below the needle latches and retaining it suspended on the needle shanks, thereafter knitting a second portion as a double welt and forming a longitudinal gap, joining the last loops of the first portion and of the first part of the double welt by knitting after having knitted the first part of the double welt, and then knitting the second part of the double welt with a longitudinal gap, both parts of the double welt being joined and the knitting of the tubular part of the second portion being continued.

7. A method of manufacturing a textile article of tubular shape having a body portion and leg portions, the body portion having a waist opening, the leg portions being connected to the body portion remote from the waist opening at a crotch part, said article having been made integrally in a circular knitting machine, wherein the knitwork of the body portion is made at least as a double knitwork in an area covering substantially the part between the waist opening in the body portion and the crotch part of said article, wherein said article comprises at least a first and a second independently knitted portion each portion being joined in the course of forming the article, said portions being knitted in a circular knitting machine, wherein to the first portion comprising a first leg part and a continuing round part of the waist portion there is joined about the circumference a third portion and partially said second portion, said second portion being situated inside the third portion and being formed as a circular unclosed waist of the body portion, said third portion comprising with the first portion the rest of the body portion and a longitudinal gap for the waist, made from the selvedge, and a second leg portion, a part of the third portion between the two longitudinal selvedges of the gap being made as a double knitwork, and the second portion being joined to the third and first portions partially about the circumference at the point of finishing the double knitwork except the transverse gap selvedges for the waist, comprising knitting the first tubular portion, transferring said first tubular portion upon finishing below the needle latches and retaining it suspended on the needle shanks, knitting a second portion thereafter as a double welt and forming longitudinal gap, and upon finishing the latter transferring its last loops below the needle latches to the loops of the first portion, thereafter knitting a third portion as a double welt and forming a longitudinal gap, joining the last loops of the first and second portions and the first part of the double welt by knitting upon finishing the first part of the double welt, then knitting the second part of the double welt with a longitudinal gap, and joining both parts of the double welt with the first loops of the second portion, the tubular part of the third portion being continued thereafter.

8. A method of manufacturing a textile article of tubular shape having a body portion and leg portions, the body portion having a waist opening, the leg portions being connected to the body portion remote from the waist opening at a crotch part, said article having been made integrally in a circular knitting machine, wherein the knitwork of the body portion is made at least as a double knitwork in an area covering substantially the part between the waist opening in the body portion and the crotch part of said article, wherein said article comprises at least a first and a second independently knitted portion each portion being joined in the course of forming the article, said portions being knitted in a circular knitting machine, wherein to the first tubular portion comprising the first leg part of the leg portion there are joined the first and third parts which are formed as unclosed circular ribbons of the leg portions and which form a double knitwork, a fourth portion being joined thereto about the circumference of their ends, said fourth portion comprising the remaining part of the leg portion and the second leg part, comprising knitting the first tubular portion and transferring it upon finishing below the needle latches, and retaining it suspended on the needle shanks, knitting the second portion as a double welt and forming a longitudinal gap, transferring its last loops upon finishing below the needle latches to the loops of the first portion, then knitting the third portion in the same manner as the second portion, and after finishing said third portion joining the last loops of the three knitted portions and knocking them off the needles, and thereafter transferring the suspended start course loops of both the second and third portions to the needles and joining them by knitting a fourth tubular portion.

9. A method as claimed in claim 7, wherein the connecting loops in the top of the double welt knitwork bending are pulled through the last loops of at least one portion.

10. A method of manufacturing a textile article of tubular shape having a body portion and leg portions, the body portion having a waist opening, the leg portions being connected to the body portion remote from the waist opening at a crotch part, said article having been made integrally in a circular knitting machine, wherein the knitwork of the body portion is made at least as a double knitwork in an area covering substantially the part between the waist opening in the body portion and the crotch part of said article, wherein said article comprises at least a first and a second independently knitted portion each portion being joined in the course of forming the article, said portions being knitted in a circular knitting machine, wherein the first portion comprises a first leg portion and a continuing round part of a waist portion, said first portion is joined to the second portion, said second portion comprises the rest of the waist portion with a longitudinal gap for the waist formed from the selvedge and a second leg portion, the part of the second portion between the two longitudinal selvedges of the gap being made in the form of a double knitwork, comprising knitting a first tubular portion as a double welt and transferring its first loops below the needle latches and retaining them on the needle shanks, continuing the knitting process on the needles, and after finishing the portion knocking off its last loops from said needles, thereafter knitting the tubular first part of the second portion, transferring the first part of the second portion upon finishing to the dial sinkers, and knitting the second part of the second portion as a double welt with a longitudinal gap, after finishing the second part of the second portion joining by knitting the last loops of said second part with the first loops of the first portion, the knitting of the third part of the second portion being continued in the form of a double welt and forming a longitudinal gap, and after finishing said third part joining the last loops thereof with the first loops of the second part of the second portion and securing them by knitting.

11. A method as claimed in claim 10, wherein the connecting loops in the top of the double welt knitwork bending are pulled through the last loops of at least one portion.

* * * * *